US008103037B2

(12) United States Patent
Bai et al.

(10) Patent No.: US 8,103,037 B2
(45) Date of Patent: Jan. 24, 2012

(54) SYSTEM FOR PRODUCING THE PARAMETERS OF A BASS-ENHANCED LOUDSPEAKER ENCLOSURE

(75) Inventors: Ming-Sian R. Bai, HsinChu (TW); Huan-Sheng Zhang, Taoyuan (TW); Rong-Liang Chen, Pingtung County (TW)

(73) Assignee: National Chiao Tung University, Hsin-Chu (TW)

( * ) Notice: Subject to any disclaimer, the term of this patent is extended or adjusted under 35 U.S.C. 154(b) by 1008 days.

(21) Appl. No.: 12/071,478

(22) Filed: Feb. 21, 2008

(65) Prior Publication Data

US 2009/0214047 A1 Aug. 27, 2009

(51) Int. Cl.
*H04R 1/20* (2006.01)

(52) U.S. Cl. ..... 381/345; 381/116

(58) Field of Classification Search ..... 381/345, 381/116
See application file for complete search history.

(56) References Cited

U.S. PATENT DOCUMENTS 4,714,133 A * 12/1987 Skaggs, Jr. ..... 181/160
6,763,117 B2 * 7/2004 Goldslager et al. ..... 381/345

* cited by examiner

*Primary Examiner* — Douglas Menz
(74) *Attorney, Agent, or Firm* — Birch, Stewart, Kolasch & Birch, LLP

(57) ABSTRACT

A system for producing parameters for a bass-enhanced loudspeaker enclosure; meanwhile, a low-frequency extended frequency, a quality and quantity ratio and radius of a port need to be defined for the system. Also, the resonance frequency of a mechanical system and the quality and quantity of a mechanical system are fixed to obtain the parameters for the frequency ratio, the length of the duct and the cavity volume inside the device, etc. and to manufacture the bass-enhanced loudspeaker enclosure.

9 Claims, 5 Drawing Sheets

(a) $0<\alpha<1$ (b) $1<\alpha<2$

SYSTEM FOR PRODUCING THE PARAMETERS OF A BASS-ENHANCED LOUDSPEAKER ENCLOSURE

FIELD OF THE INVENTION

The present invention is related to a system for producing parameters for a bass-enhanced loudspeaker enclosure.

BACKGROUND OF THE INVENTION

The performances such as the appearance, size, weight, sound quality and sound performance of video product, in addition to being decided by the design of the loudspeaker itself, will be affected by the design of bass-enhanced loudspeaker enclosure as well.

FIG. 1 is the structural illustration of bass-enhanced loudspeaker enclosure. Bass-enhanced loudspeaker enclosure 1 uses a rectangular outer casing 10 to form a cavity 11, and a loudspeaker hole 12 and a port 13 are formed on one side of the outer casing 10; meanwhile, at port 13, a duct 14 is extended toward cavity 11. Moreover, loudspeaker is placed inside cavity 11 and the sound message of the loudspeaker can be sent out through loudspeaker hole 12. In the video product industry, the structure of bass-enhanced loudspeaker enclosure 1 is a prior art structure; however, the performance of the sound message of video product is affected by the design of loudspeaker as well as appropriate parameter design of bass-enhanced loudspeaker enclosure, and the latter is usually the key of the performance of the sound quality. Wherein, the parameters of bass-enhanced loudspeaker enclosure include the radius of the port, the length of the duct and the volume of the cavity, etc.

In order respond to all kinds of video electronic products and mobile and portable devices and to propose all kinds of suitable and optimal bass-enhanced loudspeaker enclosures, professional design members or design groups have to work very hard day and night. This not only represents heavy work loads, but also represents very high cost. However, what even worse is the strict status of competition in the electronic industry, for example, very short product life cycle and very strict price and cost competition in the market.

Therefore, the inventor of the present invention, in order to prevent the tedious and hardworking process of designing bass-enhanced loudspeaker enclosure as mentioned above and to emphasize the output sound quality performance as well as to cope with the trend of thin and miniaturization in the video device, starts to solve the problem from the basis of the problem so as to deal with the possibly generated or evolved danger and injury due to urgent need or operation negligence; the inventor thus has spent a great deal of efforts accompanied with the application of theory and sample preparation and repeated trials in long period of time to propose a system for producing the parameters of bass-enhanced loudspeaker enclosure; the system can, based on the real application situation, vibration-absorber theory and the system characteristic equation, easily calculate the optimal port radius, length of duct and cavity volume. Therefore, the difficulty of product design and development can be reduced, the product designer's technological threshold hold as well as development time and cost can be greatly reduced too. Moreover, the low frequency sound output of the loudspeaker can be enhanced and the present invention is thus an invention that can reasonably and effectively improve the above mentioned drawbacks.

SUMMARY OF THE INVENTION

The objective of the present invention is to provide a system for producing parameters of bass-enhanced loudspeaker enclosure; through this system and based on the vibration-absorber theory, characteristic equation for resonance sound box and real design goal, the optimal port radius, length of duct and cavity volume can then be calculated. Therefore, anyone who does not receive professional training can easily and quickly design resonance sound box that can be used for all kinds of loudspeakers.

Another objective of the present invention is to provide a system for producing parameters of bass-enhanced loudspeaker enclosure; through this system and based on the vibration-absorber theory, characteristic equation for resonance sound box and real design goal, the optimal port radius, length of duct and cavity volume can then be calculated. Therefore, the low frequency sound sent out from the loudspeaker can be extended to the frequency region expected by the design goal delicately and accurately, and the low frequency sound message sent out from all kinds of loudspeakers can be greatly enhanced.

To achieve the above mentioned objective, the present invention is mainly to provide a system for producing parameters of bass-enhanced loudspeaker enclosure. Through the definition of a low-frequency extended frequency, a quality and quantity ratio and a port radius, and under the fixing of resonance frequency of a mechanical system and the quality and quantity of a mechanical system, a frequency ratio, a length of duct and a cavity volume are thus obtained; furthermore, the system for producing parameters of bass-enhanced loudspeaker enclosure includes an initial normalization frequency device, and an initial normalization frequency is obtained through the low-frequency extended frequency and the resonance frequency of the mechanical system; meanwhile an acoustic quality and quantity device is used to obtain an acoustic quality and quantity through the quality and quantity ratio and the mechanical system quality and quantity; a duct length device is used to obtain the duct length through the acoustic quality and quantity and the port radius; a frequency ratio device is used to obtain the frequency ratio through the normalized frequency and the quality and quantity ratio; an acoustic system resonance frequency device is used to obtain an acoustic system resonance frequency through the resonance frequency of the mechanical system and the frequency ratio; and a cavity volume device is used to obtain an acoustic compliance through the resonance frequency of the acoustic system, and then a cavity volume is obtained through the acoustic compliance.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

The present invention is to propose a system for producing parameters of bass-enhanced loudspeaker enclosure.

Through the definition of a low-frequency extended frequency, a quality and quantity ratio and a port radius needed by the bass-enhanced loudspeaker enclosure, and under the fixing of resonance frequency of a mechanical system and the quality and quantity of a mechanical system, a frequency ratio, a length of duct and a cavity volume are thus obtained. The main objective of the present invention is to reduce the design and development difficulty of a product and the development time and cost.

Figure 1:
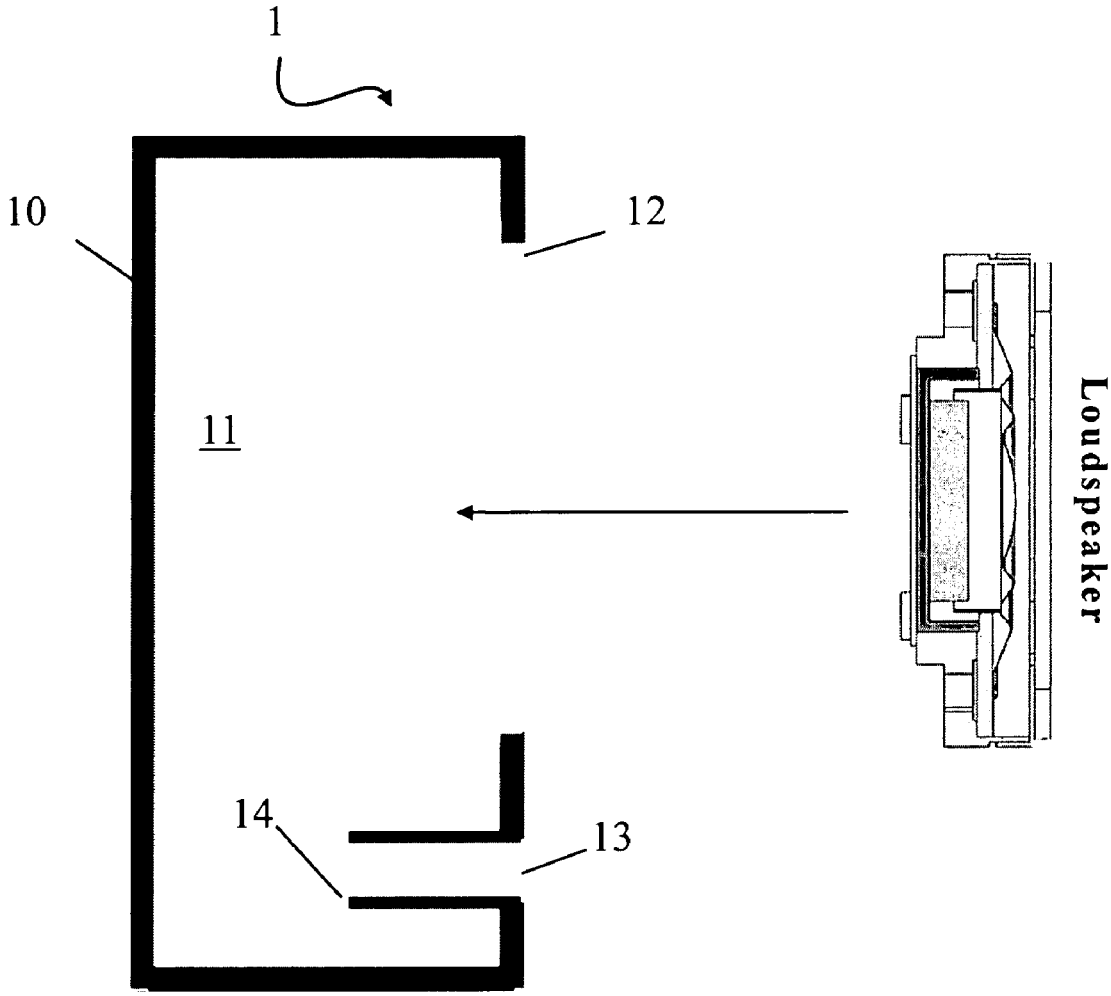
FIG. 1 is a structural illustration of a bass-enhanced loudspeaker enclosure.
Figure 2:
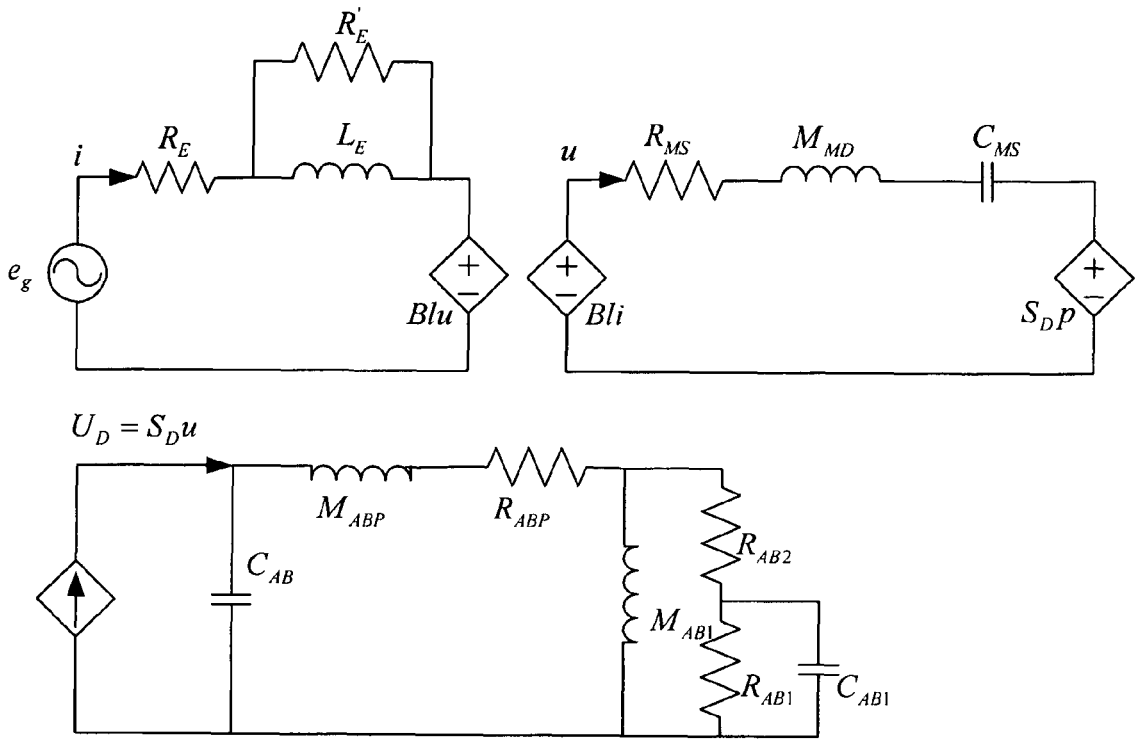
FIG. 2 is a circuit illustration converted from FIG. 1.

FIG. 2 is an electronic circuit illustration converted from FIG. 1. Before the disclosure of the system of the present invention for producing parameters of bass-enhanced loudspeaker enclosure, we have to use FIG. 2 to simulate and list related acoustic formulae to start the deduction of acoustic system so as to describe the specific relationship among low-frequency extended frequency, quality and quantity ratio and port radius and the parameters of bass-enhanced loudspeaker enclosure. Please also refer to FIG. 1 and FIG. 2, the cavity 11 part can be simulated by acoustic compliance CAB and duct 14 can be simulated by acoustic mass MABP and acoustic resistance RABP, and the related calculations are as in the followings:

$$C_{AB} = \frac{V_{AB}}{\rho_0 c^2} \tag{1}$$

$$M_{ABP} = \frac{\rho_0}{S_{VP}} L_{VP} \tag{2}$$

$$R_{ABP} = \frac{\rho_0}{\pi a_{VP}^2} \sqrt{2\omega\mu} \left( \frac{L_{VP}}{a_{VP}} + 2 \right) \tag{3}$$

Wherein, $\rho_0$ is air density, c is the speed of sound, VAB is the volume of cavity 11, $S_{VP}$ is the area of port 13, $L_{VP}$ is the length of duct 14, $\alpha_{VP}$ is the radius of port 13, ω is the angular frequency of fixed range and μ is the dynamic coefficient of viscosity; in the air and at 20° C. and 0.76 m Hg, μ=1.56×10−5 m2/s, and the angular frequency of fixed range is ω=2πf, frequency of fixed range f is 20~20 kHz. Next, the acoustic radiation impedance such as acoustic mass MAB1, acoustic resistance RAB1, RAB2 and acoustic compliance CAB1, etc., can be represented as in the followings:

$$M_{AB1} = \frac{0.6133\rho_0}{\pi a_{VP}} \tag{4}$$

$$R_{AB1} = \frac{0.5045\rho_0 c}{\pi a_{VP}^2} \tag{5}$$

$$R_{AB2} = \frac{\rho_0 c}{\pi a_{VP}^2} \tag{6}$$

$$C_{AB1} = \frac{0.55\pi^2 a_{VP}^3}{\rho_0 c^2} \tag{7}$$

Figure 3:
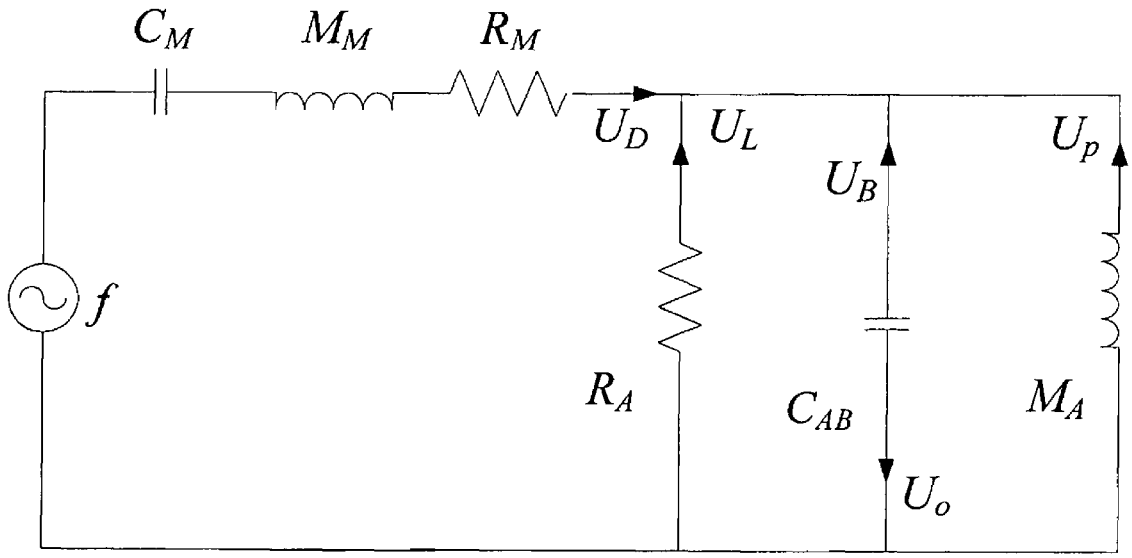
FIG. 3 is the simplified mechanical system equivalent circuit of FIG. 2.

If the resistance effect of port 13 is not considered and the electrical systems and the acoustic system are equivalently made to mechanical system, then the circuit of FIG. 2 can be simplified to the mechanical system equivalent circuit as in FIG. 3. FIG. 3 is in a form of two resonance systems of mechanical and acoustic system, and the characteristics of these two resonance systems can be analyzed by the theory of vibration absorber, hence, the mechanical impedance ZM can be represented as in the following:

$$Z_M = M_M s + R_M + \frac{1}{C_M s} = \frac{\frac{s^2}{\omega_M^2} + \frac{1}{Q_M}\frac{s}{\omega_M} + 1}{C_M s} \tag{8}$$

Wherein, MM is the mechanical system mass, RM is the mechanical system resistance, CM is the mechanical system compliance, $\omega_M$ is the resonance angular frequency of the mechanical system and $Q_M$ is the quality factor of the mechanical system. Then, acoustic admittance YA can be represented in the following form:

$$Y_A = C_{AB} s \cdot \frac{1}{R_A} + \frac{1}{M_A s} = \frac{\frac{s^2}{\omega_A^2} + \frac{1}{Q_A}\frac{s}{\omega_A} + 1}{M_A s} \tag{9}$$

Wherein, MA is acoustic mass, RA is acoustic resistance, CAB acoustic compliance, $\omega_A$ is acoustic system resonance angular frequency and $Q_A$ is acoustic system quality factor. The overall impedance ZT of FIG. 3 can be represented as in the following:

$$Z_T = Z_M + \frac{1}{Y_A} = \frac{\Delta(s)}{C_M s\left(\frac{s^2}{\omega_A^2} + \frac{1}{Q_A}\frac{s}{\omega_A} + 1\right)} \tag{10}$$

Wherein, Δ(s) is system characteristic equation, which can be represented as:

$$\Delta(s) = \left(\frac{s^2}{\omega_M^2} + \frac{1}{Q_M}\frac{s}{\omega_M} + 1\right)\left(\frac{s^2}{\omega_A^2} + \frac{1}{Q_A}\frac{s}{\omega_A} + 1\right) + M_A C_M s^2 \tag{11}$$

From equation (8), mechanical system resonance angular frequency $\omega_M$ and mechanical system quality factor $Q_M$ can be represented respectively as:

$$\omega_M = 2\pi f_M = \sqrt{\frac{1}{M_M C_M}} \tag{12}$$

$$Q_M = \frac{1}{R_M C_M \omega_M} \tag{13}$$

Wherein, fM is mechanical system resonance frequency. From equation (9), acoustic system resonance angular frequency $\omega_A$ and acoustic system quality factor $Q_A$ can then be represented respectively as:

$$\omega_A = 2\pi f_A = \sqrt{\frac{1}{M_A C_{AB}}} \tag{14}$$

$$Q_A = \frac{R_A}{C_{AB}\omega_A} \tag{15}$$

Wherein, fA is acoustic system resonance frequency. And in equation (11), characteristic equation Δ(s) can be simply represented as:

$$\Delta(s) = \frac{s^4}{\omega_0^4} + a_3\frac{s^3}{\omega_0^3} + a_2\frac{s^2}{\omega_0^2} + a_1\frac{s}{\omega_0} + 1 = 0 \quad (16)$$

Through a comparison of equation (11) and (16), initial resonance angular frequency ω0 and each of the symbol a1, a2, a3 can be represented respectively as:

$$\omega_0 = \sqrt{\omega_A\omega_M} = \frac{\omega_M}{\sqrt{\alpha}} = \omega_A\sqrt{\alpha} \quad (17)$$

$$a_1 = \frac{1}{Q_M\sqrt{\alpha}} + \frac{\sqrt{\alpha}}{Q_A} \quad (18)$$

$$a_2 = \frac{1}{\alpha} + \alpha + \frac{1}{Q_M Q_A} + \frac{\rho}{\alpha} \quad (19)$$

$$a_3 = \frac{1}{Q_A\sqrt{\alpha}} + \frac{\sqrt{\alpha}}{Q_M} \quad (20)$$

Wherein, frequency ratio α, mass ratio ρ can be represented respectively as:

$$\alpha = \frac{\omega_M}{\omega_A} = \frac{f_M}{f_A} \quad (21)$$

$$\rho = \frac{M_A}{M_M} > 0 \quad (22)$$

Wherein, acoustic mass $M_A$ can be represented as:

$$M_A = \frac{\rho_0 L_{VP}}{\pi a_{VP}^2} \quad (23)$$

If no damping situation is considered, the mechanical system quality factor $Q_M$ and acoustic system quality factor $Q_A$ will approach infinity, hence, characteristic equation Δ(s) can be represented as:

$$\Delta(s)=\alpha^2 r_M^4-(1+\alpha^2+\rho)r_M^2+1 \quad (24)$$

Wherein, Normalized Frequency rM is represented as:

$$r_M = \frac{\omega}{\omega_M} \quad (25)$$

Figure 4:
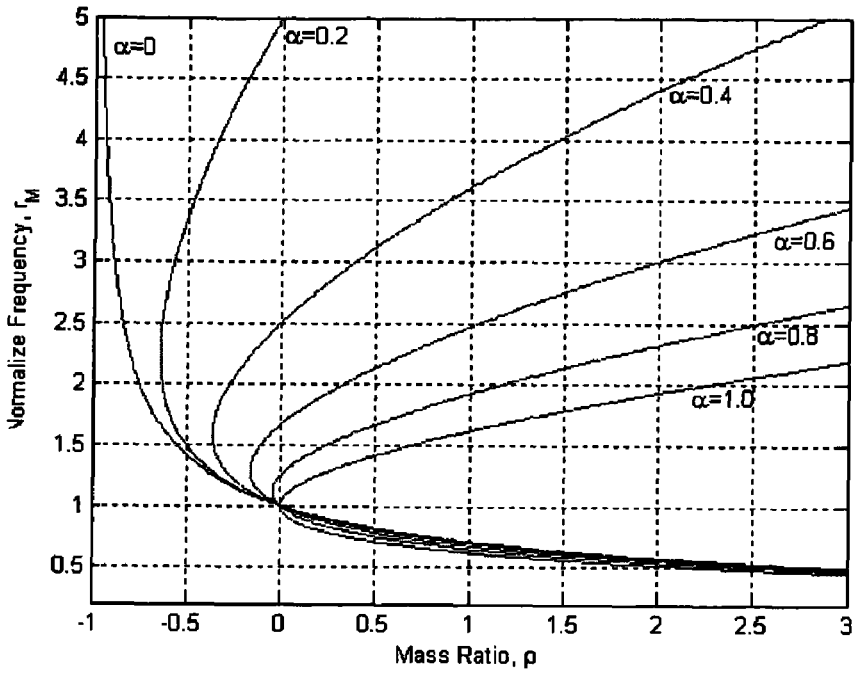
FIG. 4 is the root locus of the coupling resonant system.
Figure 4:
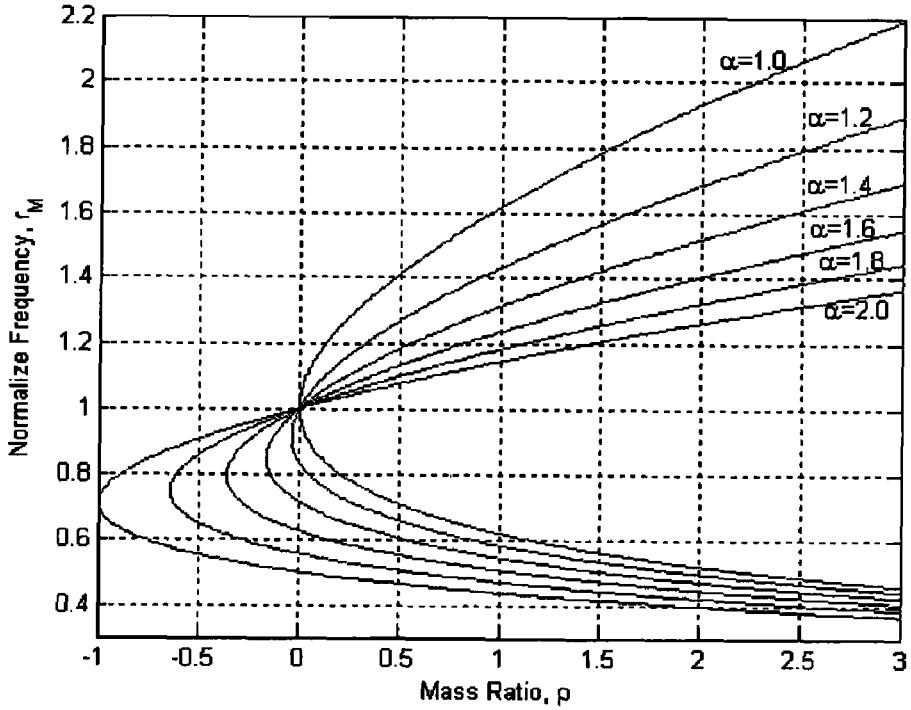

If we draw according to equation (24), we can draw the coupling resonance system root locus; as shown in FIG. 4, the horizontal axis and vertical axis are respectively normalized frequency and mass ratio. As shown in FIG. 4, through the relationship between normalized frequency rM and mass ratio ρ, we can obtain related frequency ratio α curve; but what needs to be noticed is, the part with mass ratio smaller than 0 as in the figure actually does not possibly exist and is only mathematical representation which can not be applied in real design. Through the coupling resonance system root locus of FIG. 4 and under the consideration that the present invention is targeting for the design of acoustic system, hence, the mechanical system resonance frequency $f_M$ will not change, that is, it is of fixed value; meanwhile, acoustic system resonance frequency $f_A$ must be smaller than mechanical system resonance frequency $f_M$.

Figure 5:
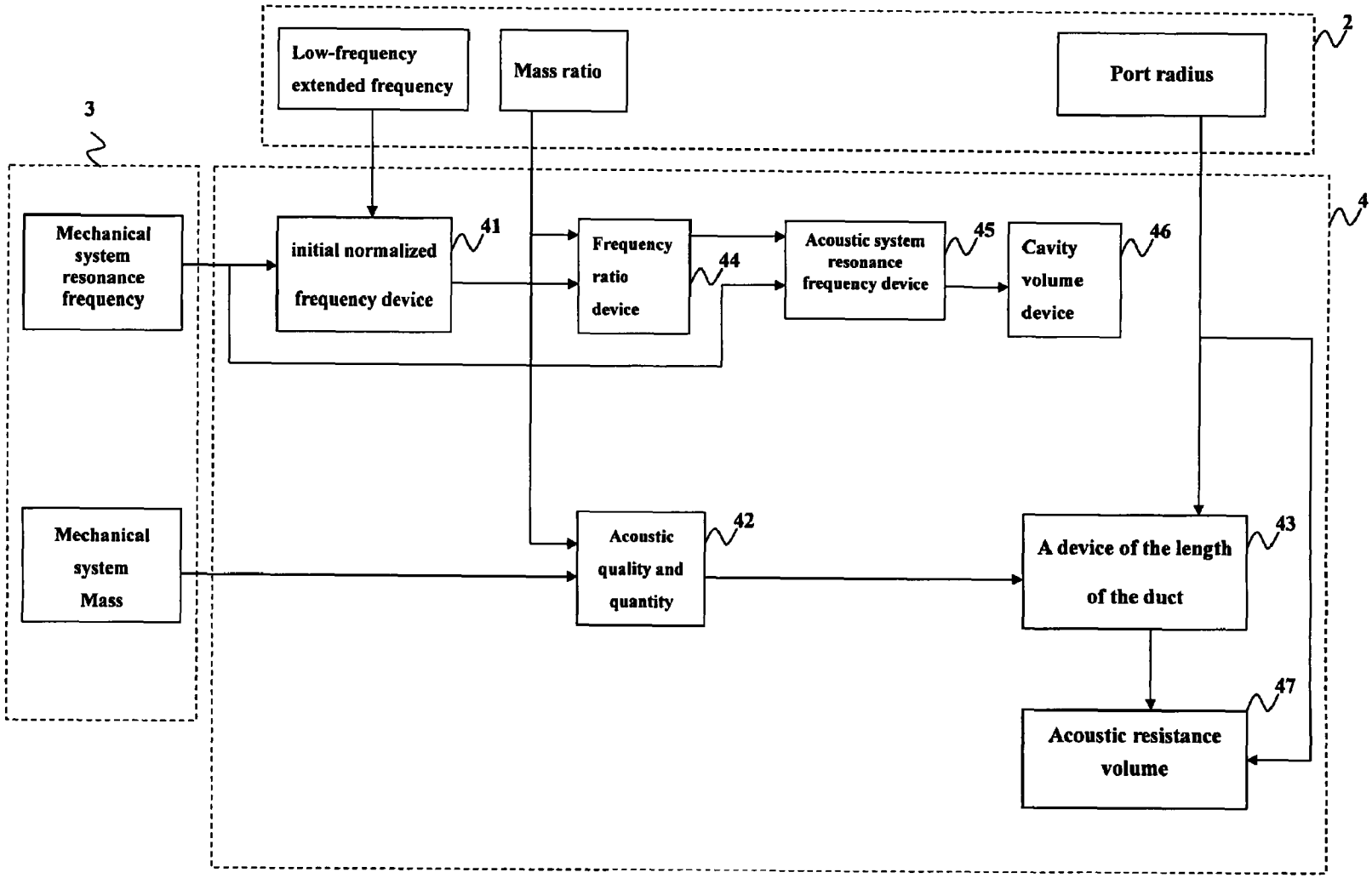
FIG. 5 is an illustration of the system for producing parameters of a bass-enhanced loudspeaker enclosure of the present invention.

FIG. 5 is an illustration of the system of the present invention for producing parameters of bass-enhanced loudspeaker enclosure. Through the definition of low-frequency extended frequency f1, mass ratio ρ and port radius $\alpha_{VP}$ by an input device 2 and under the fixing of mechanical system resonance frequency $f_M$ and mechanical system mass $M_M$ through fixing device 3, the frequency ratio α, duct length $L_{VP}$ and cavity volume $V_{AB}$ is then obtained by the system 4 of the present invention which generates the parameters of bass-enhanced loudspeaker enclosure. System 4 of the present invention which generates the parameters of bass-enhanced loudspeaker enclosure includes a initial normalized frequency device 41, an acoustic quality and quantity device 42, a duct length device 43, a frequency ratio device 44, an acoustic system resonance frequency device 45 and a cavity volume device 46. Initial normalized frequency device 41 is to receive the low-frequency extended frequency $f_1$ as defined in the input device 2 and the fixed mechanical system resonance frequency $f_M$ fixed in the fixing device 3, that is, the initial normalized frequency r1 can then be obtained. What needs to be noticed here is, initial normalized frequency device 41 uses equation (25) so that initial normalized frequency $$r_1 = \frac{f_1}{f_M}$$

can be obtained because both low-frequency extended frequency $f_1$ and mechanical system resonance frequency $f_M$ are all known. Acoustic quality and quantity device 42 is used to receive the acoustic ratio ρ defined in input device 2 and the fixed mechanical system mass $M_M$ as fixed in the fixing device 3 so as to obtain an acoustic mass $M_A$. Acoustic mass $M_A$ uses equation (22) to make mathematical operation, that is, acoustic mass $M_A$ is obtained through the product of mass ratio ρ and mechanical system mass $M_M$. The duct length device 43 is to receive the acoustic mass $M_A$ generated by acoustic quality and quantity device 42 and the port radius $\alpha_{VP}$ as defined by input device 2, that is, the duct length $L_{VP}$ can be obtained. What needs to be noticed here is that duct length device 43 is used through equation (23) to obtain duct length $L_{VP}$ under air density $\rho_0$ and ratio of the circumference of a circle to the diameter π of constant and through known acoustic mass $M_A$ and port radius $\alpha_{VP}$. Frequency ratio device 44 is to receive the initial normalized frequency r1 and mass ratio ρ generated by initial normalized frequency device 41 so as to obtain frequency ratio α. Frequency ratio device 44 is to use FIG. 4 coupling resonance system root locus to find out frequency ratio α curve from known mass ratio ρ and normalized frequency r1. Acoustic system resonance frequency device 45 is to receive the fixed mechanical system resonance frequency $f_M$ in the fixing device 3 and the frequency ratio α generated by the frequency ratio device 44 so as to obtain an acoustic system resonance frequency $f_A$. Acoustic system resonance frequency device 45 is to use equation (21) and perform mathematical operation from the known mechanical system resonance frequency $f_M$, that is, divide mechanical system resonance frequency $f_M$ by frequency ratio α to obtain acoustic system resonance frequency $f_A$. Cavity volume device 46 is first to receive the acoustic system resonance frequency $f_A$ generated by acoustic system resonance frequency device 45 so as to obtain an acoustic compliance $C_{AB}$, then through acoustic compliance $C_{AB}$, cavity volume $V_{AB}$ is obtained. Cavity volume device 46 uses equation (12) to obtain acoustic compliance $C_{AB}$ from the known acoustic system resonance frequency $f_A$ and acoustic mass MA, then, it uses equation (1) under air density $\rho_0$ and constant velocity of sound c to get cavity volume $V_{AB}$ from the known acoustic compliance $C_{AB}$.

In FIG. 5, system 4 which produces parameters of bass-enhanced loudspeaker enclosure, after the generation of duct length $L_{VP}$ through duct length device 43 and the generation of frequency ratio $\alpha$ through frequency ratio device 44 and the generation of cavity volume $V_{AB}$ through cavity volume device 46, can let the user obtain parameters of bass-enhanced loudspeaker enclosure such as duct length $L_{VP}$, frequency ratio $\alpha$ and cavity volume $V_{AB}$ through a display device. In addition, system 4, which generates parameters of bass-enhanced loudspeaker enclosure, further comprises of an acoustic resistance device 47, can be used to obtain acoustic resistance $R_{ABP}$ through equation (3) when air density is $\rho_0$ and dynamic coefficient of viscosity $\mu$ is of constant and through known duct length $L_{VP}$ and port radius $\alpha_{VP}$ accompanied with angular frequency of fixed range $\omega$. Moreover, through acoustic resistance $R_{ABP}$, we can draw frequency response chart to perform further analysis.

Therefore, through the technology disclosed above, the present invention can indeed provide a way to calculate optimal port radius, duct length and cavity volume according to vibration absorber theory, resonance sound box characteristic equation and real design goal; furthermore, a resonance sound box that an be used by all kinds of loudspeakers can be easily and quickly designed. At the same time, the low-frequency sound sent out from the loudspeaker can be extended to the frequency zone expected by the design goal delicately and accurately so that the low-frequency sound message sent out from all kinds of loudspeakers can be enhanced.

Therefore, a bass-enhanced loudspeaker enclosure is realized in this invention, which is totally different than the prior art design; meanwhile, it not only can enhance the overall utilization value but also is not seen in published journal or is not in public use, it indeed meets the requirements of a patent and we thus propose a patent application.

However, the above disclosed drawings and descriptions are only some of the embodiments of the present invention, anyone who is familiar with this art can still makes several modifications and changes based on the above mentioned descriptions, and these changes should still fall within the spirit of this invention and within what is claimed of this invention.

What is claimed is:

1. A system for producing parameters of bass-enhanced loudspeaker enclosure is used to obtain a frequency ratio, a duct length and a cavity volume length through the definition of a low-frequency extended frequency, a mass ratio and a port radius and under fixed mechanical system resonance frequency and a mechanical system mass; the system for producing parameters of bass-enhanced loudspeaker enclosure comprising of:

an initial normalized frequency device, which is used to obtain an initial normalized frequency through the low-frequency extended frequency and the mechanical system resonance frequency;

an acoustic quality and quantity device, which is used to obtain an acoustic mass through the mass ratio and the mechanical system mass;

a duct length device, which is used to obtain the duct length through the acoustic mass and the port radius;

a frequency ratio device, which is used to obtain the frequency ratio through the initial normalized frequency and the mass ratio;

an acoustic system resonance frequency device, which is used to obtain an acoustic system resonance frequency through the mechanical system resonance frequency and the frequency ratio; and a cavity volume device, which is used to obtain an acoustic compliance through the acoustic system resonance frequency and to obtain the cavity volume through the acoustic compliance.

2. The system for producing parameters of bass-enhanced loudspeaker enclosure of claim 1 wherein the initial normalized frequency device is to obtain the initial normalized frequency through a product of the initial low-frequency extended frequency and the mechanical system resonance frequency.

3. The system for producing parameters of bass-enhanced loudspeaker enclosure of claim 1 wherein the acoustic quality and quantity device is to obtain the acoustic mass through a product of the mass ratio and the mechanical system mass.

4. The system for producing parameters of bass-enhanced loudspeaker enclosure of claim 1 wherein the duct length device is to obtain the duct length $L_{VP}$ through $$M_A = \frac{\rho_0 L_{VP}}{\pi a_{VP}^2},$$

wherein MA is the acoustic mass, $\rho_0$ is air density and $\alpha_{VP}$ is the port radius.

5. The system for producing parameters of bass-enhanced loudspeaker enclosure of claim 1 wherein the frequency ratio device is to obtain the frequency ratio through the relation between the normalized frequency and the mass ratio in the vibration absorber theory.

6. The system for producing parameters of bass-enhanced loudspeaker enclosure of claim 1 wherein the acoustic system resonance frequency device is to obtain the acoustic system resonance frequency through the division of the mechanical system resonance frequency by the frequency ratio.

7. The system for producing parameters of bass-enhanced loudspeaker enclosure of claim 1 wherein the cavity volume device is to obtain the acoustic compliance CAB through $$2\pi f_A = \sqrt{\frac{1}{M_A C_{AB}}};$$

where fA is the acoustic system resonance frequency and MA is the acoustic mass.

8. The system for producing parameters of bass-enhanced loudspeaker enclosure of claim 1 wherein the cavity volume device is to obtain the cavity volume $V_{AB}$ through $$C_{AB} = \frac{V_{AB}}{\rho_0 c^2};$$

where CAB is the acoustic compliance, $\rho_0$ is air density and c is the velocity of sound.

9. The system for producing parameters of bass-enhanced loudspeaker enclosure of claim 1 further comprises of an acoustic resistance device so as to obtain the acoustic resistance $R_{AP}$ through $$R_{ABP} = \frac{\rho_0}{\pi a_{VP}^2}\sqrt{2\omega\mu}\left[\frac{L_{VP}}{a_{VP}} + 2\right];$$

where $\rho_0$ is air density, $\mu$ is dynamic coefficient of viscosity, $L_{VP}$ is the duct length, $\alpha_{VP}$ is the port radius and $\omega$ is fixed range angular frequency.

* * * * *